US010642304B1

(12) United States Patent
Shreepathi Bhat

(10) Patent No.: US 10,642,304 B1
(45) Date of Patent: May 5, 2020

(54) LOW VOLTAGE ULTRA-LOW POWER CONTINUOUS TIME REVERSE BANDGAP REFERENCE CIRCUIT

(71) Applicant: Texas Instruments Incorporated, Dallas, TX (US)

(72) Inventor: Avinash Shreepathi Bhat, Tucson, AZ (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 16/180,143

(22) Filed: Nov. 5, 2018

(51) Int. Cl.
*G05F 3/02* (2006.01)
*G05F 3/26* (2006.01)
*G05F 3/30* (2006.01)

(52) U.S. Cl.
CPC ..... *G05F 3/262* (2013.01); *G05F 3/30* (2013.01)

(58) Field of Classification Search
CPC . G05F 3/30; G05F 3/245; G05F 3/247; G05F 3/262; G05F 3/265; G05F 3/267; G05F 1/563
See application file for complete search history.

(56) References Cited

U.S. PATENT DOCUMENTS 6,225,796 B1 5/2001 Nguyen
2007/0109037 A1* 5/2007 Lin ..... G05F 3/30 327/539
2009/0295465 A1 12/2009 Tripodi et al.
2010/0072972 A1* 3/2010 Yoshikawa ..... G05F 3/30 323/313

OTHER PUBLICATIONS

Seok et al., "A Portable 2-Transistor Picowatt Temperature-Compensated Voltage Reference Operating at 0.5 V", IEEE Journal of Solid-State Circuits, vol. 47, No. 10, Oct. 2012, pp. 2534-2545.
Ivanov et al., "An Ultra Low Power Bandgap Operational at Supply From 0.75 V", IEEE Journal of Solid-State Circuits, vol. 47, No. 7, Jul. 2012, pp. 1515-1523.
Osaki et al., "1.2-V Supply, 100-nW, 1.09-V Bandgap and 01-V Supply, 52.5-nW, 0.55-V Subbandgap Reference Circuits for Nanowatt CMOS LSIs", IEEE Journal of Solid-State Circuits, vol. 48, No. 6, Jun. 2013, pp. 1530-1538.
Magnelli et al., "A 2.6 nW, 0.45 V Temperature-Compensated Subthreshold CMOS Voltage Reference", IEEE Journal of Solid-State Circuits, vol. 46, No. 2, Feb. 2011, pp. 465-474.
(Continued)

*Primary Examiner* — Long Nguyen
(74) *Attorney, Agent, or Firm* — Mark Allen Valetti; Charles A. Brill; Frank D. Cimino

(57) ABSTRACT

A bandgap voltage circuit with a first circuit to generate an output voltage as a sum of a first voltage with an amplitude that is proportional to absolute temperature, and a first feedback voltage with an amplitude that is complementary to absolute temperature, a second circuit to generate a voltage having an amplitude that is complementary to absolute temperature, a scaling circuit to generate a second feedback voltage with an amplitude that is a fraction of the voltage of the control terminal, and a regulator circuit to regulate the first feedback voltage according to the second feedback voltage by controlling a first input current of the first circuit and a second input current of the second circuit.

13 Claims, 6 Drawing Sheets

(56) References Cited

OTHER PUBLICATIONS

Banba et al., "A CMOS Bandgap Reference Circuit with Sub-1-V Operation", IEEE Journal of Solid-State Circuits, vol. 35, No. 5, May 1999, pp. 670-674.
Lee et al. "A Subthreshold Voltage Reference With Scalable Output Voltage for Low-Power IoT Systems" IEEE Journal of Solid-State Circuits, vol. 52, No. 5 May 2017, pp. 1443-1449.
Yannis P. Tsividis "Accurate Analysis of Temperature Effects in IC-VBE Characteristics with Application to Bandgap Reference Sources" IEEE Journal of Solid-State Circuits, vol. SC-15, No. 6, Dec. 1980, pp. 1076-1084.

* cited by examiner

LOW VOLTAGE ULTRA-LOW POWER CONTINUOUS TIME REVERSE BANDGAP REFERENCE CIRCUIT

BACKGROUND

Bandgap references are electronic circuits that ideally provide a fixed output voltage signal used as a reference to other circuitry, such as analog to digital converters (ADCs), voltage regulators, sensors, and the like. Temperature stability of a bandgap reference is often achieved by combining a circuit signal that is proportional to absolute temperature (PTAT) with a signal that is complementary to absolute temperature (CTAT). Existing designs provide an output voltage of about 1.2-1.3 V based on the nominal theoretical 1.22 eV bandgap of silicon at 0° Kelvin based on a voltage difference between two p-n junctions (e.g., $\Delta V_{GS}$). This limits the minimum operating voltage to about 1.4 V in practice. However, stable reference voltages are needed in low-voltage, low-power circuit applications in which supply voltages of 1.0 V or less are available. Existing low-voltage bandgap reference designs are largely incapable of achieving a precision voltage reference from a supply voltage under 1.0 V over a wide temperature range (e.g., −50° C. to +150° C.), while consuming currents below 1 uA. One approach for a low voltage bandgap reference is to use an internal charge pump circuit to boost a low voltage supply to 1.4 V or higher, but this is noisy, adds cost and requires additional circuit area. Other approaches use MOSFET transistors and fractional bandgap references which can operate at low supply voltage levels using current summing circuits. However, these circuits typically suffer from poor accuracy at low currents, have multiple stable operating points at cold temperatures which limit practical operational temperature ranges, and the circuits use large resistors to generate CTAT currents and are thus not area efficient for ultralow power applications. Reverse bandgap circuits can provide robust accuracy across processes, but these approaches also suffer from multiple operating points and are not area efficient. An area efficient approach uses the threshold voltage difference between two transistors (e.g., $\Delta V_T$) to generate a Zero Temperature Coefficient (ZTC) reference signal, but this approach suffers from uncontrolled current levels and the accuracy is not robust across processes.

SUMMARY

Described examples provide a bandgap voltage circuit with a first circuit to generate an output voltage as a sum of a first voltage with an amplitude that is proportional to absolute temperature, and a first feedback voltage with an amplitude that is complementary to absolute temperature, a second circuit to generate a voltage having an amplitude that is complementary to absolute temperature, a scaling circuit to generate a second feedback voltage with an amplitude that is a fraction of the voltage of the control terminal, and a regulator circuit to regulate the first feedback voltage according to the second feedback voltage by controlling a first input current of the first circuit and a second input current of the second circuit. Example methods include providing a first current to generate a first feedback voltage across a resistor, providing a second current to generate a CTAT voltage across a transistor, scaling the transistor voltage to generate a second feedback voltage, generating an output voltage as a sum of the first feedback voltage, and a PTAT voltage, and regulating the first feedback voltage according to the second feedback voltage by controlling the amplitudes of the first and second currents. Disclosed examples facilitate robust accuracy across multiple processes for generated CTAT and PTAT voltages over wide temperature ranges, along with controlled circuit current levels to provide improved solutions for low-voltage, low-power applications.

DETAILED DESCRIPTION

Figure 1:
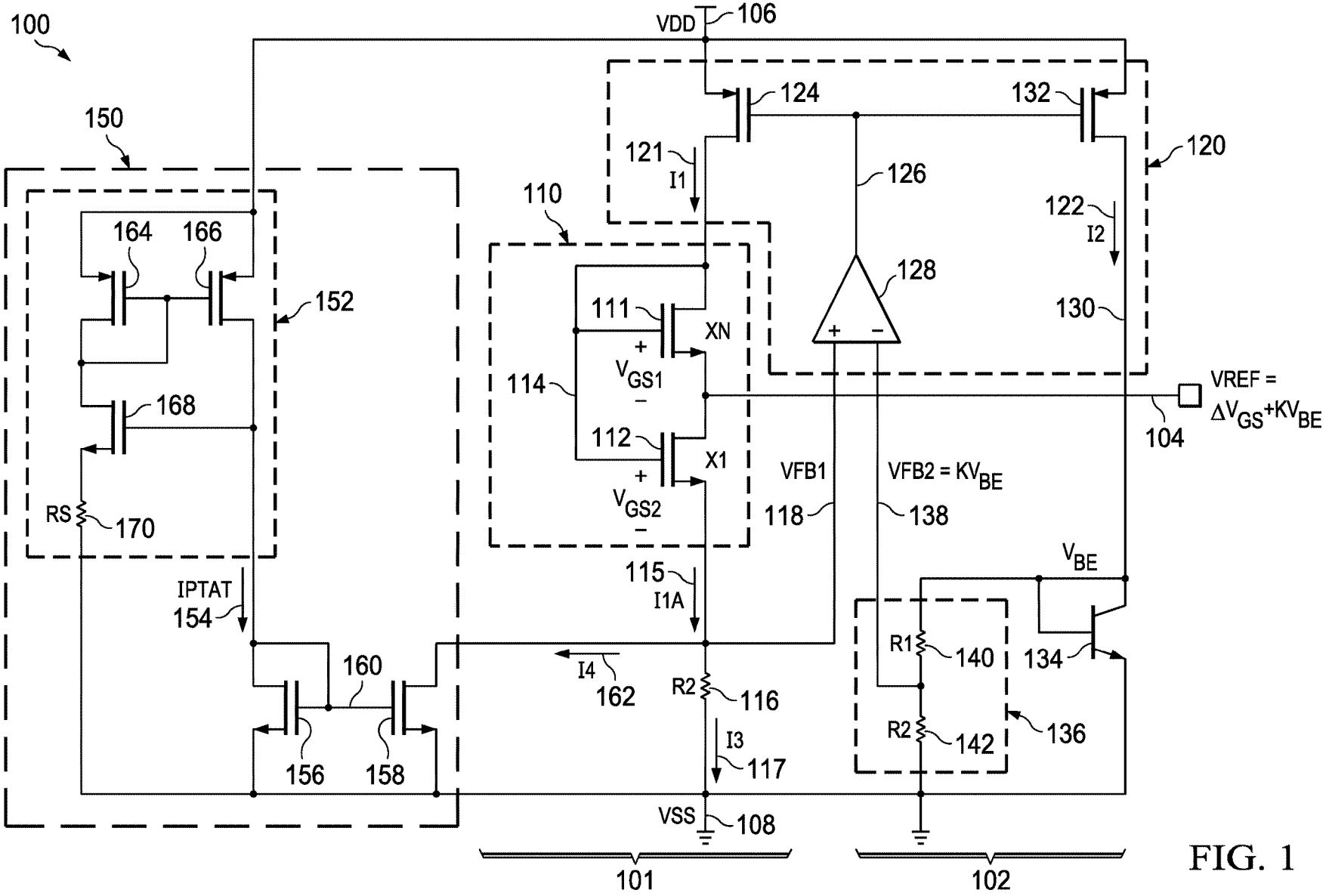
FIG. 1 is a schematic diagram of a bandgap voltage circuit according to one aspect of the present disclosure.

In the drawings, like reference numerals refer to like elements throughout, and the various features are not necessarily drawn to scale. In the following discussion and in the claims, the terms "including", "includes", "having", "has", "with", or variants thereof are intended to be inclusive in a manner similar to the term "comprising", and thus should be interpreted to mean "including, but not limited to . . . " Also, the terms "coupled", "couple" or "couples" are intended to include indirect or direct electrical or mechanical connection or combinations thereof. For example, if a first device couples to or is coupled with a second device, that connection may be through a direct electrical connection, or through an indirect electrical connection via one or more intervening devices and/or connections.

FIG. 1 shows an example bandgap voltage circuit 100. The bandgap voltage circuit 100 includes a first circuit 101, a second circuit 102, and an output node 104 that provides an output voltage VREF. The first and second circuits 101 and 102 are each coupled between a supply node 106 and a reference node 108. In one example, the reference node 108 is a ground reference with a ground or common voltage VSS and the supply node 106 has a positive voltage VDD relative to the voltage VSS, although not a requirement of all implementations. The first circuit 101 includes a self-cascoded transistor circuit 110 with a first transistor 111 of size XN connected in series with a second transistor 112 of size X1. As used herein, a self-cascoded transistor circuit has two or more transistors connected in series with one another, with control terminals of the transistors connected together. In the example of FIG. 1, the gate terminals of the transistors 111 and 112 are connected together, and are connected to the drain of the transistor 111. Other self-cascoded transistor circuit implementations can be used, which include more than two series-connected transistors with control terminals connected together. In the illustrated example, the transistors 111 and 112 are n-channel MOSFETs (e.g., NMOS) of different sizes, but with same gate length and channel width per finger to ensure good matching. In one example, the first transistor 111 has an effective width larger by a factor of "N". The first circuit 101 includes a first input node 114 that couples the circuit 110 with the supply node 106. The second transistor 112 of the first circuit 101 provides a first output current 115 with an amplitude I1A to a resistor 116. The resistor 116 has a resistance R2, and the resistor 116 controls a first feedback voltage VFB1 according to a current 117 having an amplitude I3. The current 117 is based at least partially on the first output current 115 from the self-cascoded transistor circuit 110. A first feedback node 118 connects the source of the second transistor 112 to the resistor 116.

The self-cascoded transistor circuit 110 is connected between the first input node 114 and the first feedback node 118. The self-cascoded transistor circuit 110 can be any cascode connected transistors, such as the MOSFET transistors 111 and 112 in the example of FIG. 1. The first transistor 111 includes a drain connected to the first input node 114, a source connected to the output node 104, and a gate connected to the first input node 114. The second transistor 112 includes a drain connected to the output node 104, a source connected to the first feedback node 118, and a gate connected to the first input node 114. A regulator circuit 120 is coupled between the supply node 106 and the first input node 114. The regulator circuit 120 provides a first input current 121 with a first amplitude I1 to the first input node 114. Apart from any loss current in the transistors 111 and/or 112, the self-cascoded transistor circuit 110 conducts the first input current 121 to the first feedback node 118 as the first output current 115.

The self-cascoded transistor circuit 110 provides the output voltage VREF as a sum of the first feedback voltage VFB1 and a first voltage, in this case the difference between the gate-source voltages $V_{GS}$ of the transistors 111 and 112 (e.g., VREF=VFB1+$\Delta V_{GS}$, where $\Delta V_{GS}=V_{GS2}-V_{GS1}$, $V_{GS1}$ is the gate-source voltage of the first NMOS transistor 111, and $V_{GS2}$ is the gate-source voltage of the second NMOS transistor 112). The first voltage $\Delta V_{GS}$ is a PTAT voltage that is proportional to absolute temperature. As used herein, PTAT signals (e.g., PTAT voltage and current signals), are electrical signals that increase with increasing temperature in a generally proportional manner, and PTAT circuits are those that have a positive temperature coefficient (PTC). Also, CTAT signals (e.g., CTAT voltage and current signals), are electrical signals that decrease with increasing temperature in a generally proportional manner, and CTAT circuits are those that have a negative temperature coefficient (NTC). The regulator circuit 120 provides the first input current 121 to the first input terminal 114, and the self-cascoded transistor circuit 110 provides the corresponding current 115 that controls the amplitude of the first feedback voltage VFB1 at the first feedback node 118.

The regulator circuit 120 also provides a second input current 122 to the second circuit 102. The second input current 122 has an amplitude I2. The regulator circuit 120 includes a first regulator transistor 124 connected between the supply node 106 and the first input terminal 114 of the self-cascoded transistor circuit 110. In one example, the first regulator transistor 124 is a p-channel MOSFET (e.g., PMOS) transistor with a source connected to the supply node 106, a gate terminal connected to a control node 126, and a source terminal. Other types and forms of mirror circuit transistors can be used in other implementations. The source terminal of the first regulator transistor 124 is connected to the first input terminal 114 to provide the first input current 121 to the first circuit 101.

The regulator circuit 120 also includes an amplifier 128 with an output connected to the control node 126. The amplifier 128 controls the first amplitude I1 of the first input current 121, and the second amplitude I2 of the second input current 122, according to the difference between the first feedback voltage VFB1 and a second feedback voltage VFB2 from the second circuit 102. The amplifier 128 provides a closed-loop that regulates the first feedback voltage VFB1 according to the second feedback voltage VFB2 by controlling the first input and second input currents 121 and 122 provided to the first and second circuits 101 and 102, respectively. The second circuit 102 includes a second input node 130 that connects a second current regulator transistor 132 with a transistor 134 between the supply node 106 and the reference node 108. The second regulator transistor 132 is a p-channel MOSFET (e.g., PMOS) transistor with a source connected to the supply node 106, a gate terminal connected to the control node 126, and a source terminal that provides the second input current 122 to the second circuit 102. In one example, the second regulator transistor 132 is the same size as that of the first regulator transistor 124. In another example, the second regulator transistor 132 is larger than the first regulator transistor 124, such as twice as large.

In one example, the transistor 134 of the second circuit 102 is an NPN, diode connected bipolar transistor, although other types and forms of transistor can be used in different implementations. In the illustrated example, the collector and base control terminal of the transistor 134 are connected to the second input node 130, and the emitter of the transistor 134 is connected to the reference node 108. The diode-connected NPN bipolar transistor 134 provides the base-emitter voltage $V_{BE}$ to the control terminal at the second input node 130 with an amplitude that is complementary to absolute temperature (CTAT). As used herein, PTAT or "proportional to absolute temperature" or "proportional to temperature" characterizes a device or a circuit that provides or controls a signal, such as a current or voltage, in a manner that increases or decreases generally proportional to an increase or decrease in absolute temperature, respectively. For example, the amplitude of a PTAT voltage signal increases with increasing temperature, and decreases with decreasing temperature. Similarly, a transistor or circuit with a PTAT characteristic generates a signal that increases with increasing temperature, and decreases with decreasing temperature. As used herein, CTAT or "complementary to absolute temperature" or "complementary to temperature" characterizes a device or a circuit that provides or controls a signal, such as a current or voltage, in a manner that increases or decreases inversely with an increase or decrease in absolute temperature, respectively. For example, the amplitude of a CTAT voltage signal decreases with increasing temperature, and increases with decreasing temperature. Similarly, a transistor or circuit with a CTAT characteristic generates a signal that decreases with increasing temperature, and increases with decreasing temperature.

The second circuit 102 further includes a scaling circuit 136 coupled between the transistor 134 and the reference node 108. The scaling circuit 136 includes a second feedback node 138 having the second feedback voltage VFB2. In operation, the scaling circuit 136 scales a base-emitter voltage $V_{BE}$ of the diode-connected transistor 134 to provide the second feedback voltage VFB2 with an amplitude $KV_{BE}$ that is a fraction of the voltage $V_{BE}$ of the control terminal 130 (e.g., VFB2=$KV_{BE}$). The scaling circuit 136 includes a first divider resistor 140 with a resistance R1 connected between the second input node 130 and the second feedback node 138. The first divider resistor 140 includes a first terminal connected to the second input node 130, and a second terminal connected to the second feedback node 138. The scaling circuit 136 also includes a second divider resistor 142 with a resistance R2 connected between the second feedback node 136 and the reference node 108. The second divider resistor 142 includes a first terminal connected to the second feedback node 138, and a second terminal connected to the reference node 108.

The resistive voltage divider circuit formed by the series connection of the resistors 140 and 142 between the control terminal of the transistor 134 and the reference node 108 scales the base-emitter voltage $V_{BE}$ of the diode-connected transistor 134. The second feedback node 138 that joins the resistors 140 and 142 generates the second feedback voltage VFB2 with the amplitude $KV_{BE}$. In this example, K is a scaling factor representing the ratio R1/(R1+R2). In one example, the resistor 116 of the first circuit 101 has a resistance R2 equal to the resistance R2 of the second divider resistor 142, although not a strict requirement of all possible implementations. Although the illustrated scaling circuit 136 is a resistive divider, other forms and types of scaling circuits can be used in other implementations that generate the second feedback voltage VFB2 is a fraction of the transistor voltage $V_{BE}$ of the second circuit 102.

The scaling circuit 136 provides the second feedback voltage VFB2 at the second feedback node 138. The second feedback node 138 is connected to an inverting input (−) of the amplifier 128. The non-inverting input (+) is connected to the first feedback node 118 to receive the first feedback voltage VFB1. The amplifier 128 includes an output terminal connected to the gate control terminals of the first and second regulator transistors 124 and 132 at the control node 126. The amplifier 128 provides an output voltage according to the difference between the first and second feedback voltages VFB1 and VFB2. The voltage at the control node 126 controls the first amplitude I1 of the first input current 121, and the second amplitude I2 of the second input current 122.

The regulator circuit 120 provides closed loop control of the first input current 121, which in turn affects the current 117 through the first circuit resistor 116. The negative feedback of the scaled CTAT voltage represented by the second feedback voltage (VFB2=$KV_{BE}$) regulates the current first feedback voltage VFB1 to be generally equal to the second feedback voltage VFB2. As previously mentioned, the output voltage VREF is generated by the first circuit 101 as the sum of VFB1 and the gate-source voltage $V_{GS}$ of the transistor 112 (e.g., VREF=VFB1+$V_{GS}$). In this regard, the closed-loop regulation of the first feedback voltage VFB1 to be equal to the second feedback voltage (VFB1=VFB2=$KV_{BE}$) causes the first feedback voltage at the first feedback voltage node 118 to be a CTAT signal that generally decreases with increasing circuit temperature. At the same time, the gate-source difference voltage $\Delta V_{GS}$ of the transistors 111 and 112 is a PTAT signal with an amplitude that varies proportional to absolute temperature (e.g., increases with increasing temperature). Thus, the bandgap voltage circuit 100 provides the output voltage VREF with a generally zero temperature coefficient (ZTC) having a generally temperature independent value. In addition, the scaling of the CTAT feedback through the scaling circuit 136 facilitates low-voltage operation of the circuit 100. In addition, the ZTC characteristic of the output voltage VREF is robust across different processes. In these respects, the bandgap voltage circuit 100 of FIG. 1 provides improvements over conventional designs, particularly for low-voltage, low-power applications. Moreover, the example circuit 100 does not require supply voltage boost circuitry, and provides a robust efficient solution for applications with supply voltages of 1.0 V or less.

The current/voltage (I-V) relationship for the self-cascoded MOSFETs (e.g., the transistors 111 and 112 of the self-cascoded circuit 110 in FIG. 1) operating in a sub threshold region is given by the following equations (1) and (2):

$$I = \mu C_{ox}\frac{W}{L}(m-1)V_T^2\exp\left(\frac{V_{gs}-V_{th}}{mV_T}\right)\left(1-\exp\left(\frac{-V_{ds}}{V_T}\right)\right), \quad \text{where } m = 1+\frac{C_d}{C_{ox}} \tag{1}$$

$$I \cong \mu C_{ox}\frac{W}{L}(m-1)V_T^2\exp\left(\frac{V_{gs}-V_{th}}{mV_T}\right) \tag{2}$$

In these formulas, $C_{ox}$ is a capacitance of the MOSFET gate oxide, $C_d$ is the MOSFET depletion capacitance, $V_{gs}$ is the gate-source voltage, $V_{ds}$ is the drain-source voltage, $V_T$ is the thermal voltage, and $V_{th}$ is the threshold voltage, where $V_{ds}$>4.7 $V_T$ ensures <1% loss of accuracy. For the same current (e.g., I1 in FIG. 1) through the MOSFETs 111 and 112, $\Delta V_{GS}=V_{GS1}-V_{GS}2=mV_T\ln(N)$, which exhibits a PTAT characteristic. In one example, the scaling circuit 136 and the transistor 134 control the current 121 flowing through the self-cascoded transistors 111 and 112, and the length and width dimensions of the transistors 111 and 112 is designed large enough such that the transistors 111 and 112 operate at sub threshold bias current levels for the provided current 121. The bipolar transistor voltage $V_{BE}$ includes a nonlinear third term which varies as a logarithmic function of temperature in a CTAT fashion, as shown in equations (3), (4), and (5) below.

$$V_{BE} = V_{BG} + (V_{BE0}-V_{BG})\frac{T}{T_0} + (3-n)V_T\ln\left(\frac{T_0}{T}\right) \tag{3}$$

$$k * V_{BE}\left(\frac{R_2}{R_1+R_2}\right)V_{BE}, \text{ which is } CTAT. \tag{4}$$

$$\text{VREF}=\Delta V_{GS}+kV_{BE}\cong=k*V_{BG}. \tag{5}$$

The self-Cascoded MOSFETs 111 and 112 achieve $\Delta V_{GS}$ while generally carrying the same current 121 (e.g., the current 121 and the current 115 are substantially equal, other than leakage currents). Consequently, example implementations do not need current mirrors and any associated errors can be mitigated or avoided. Certain examples can include compensation circuitry 150, such as a current source 152 and a current mirror circuit 156, 158, although not required of all possible implementations. The currents generated in the legs of the second circuit (e.g., the bipolar transistor leg, and the resistive divider leg) are CTAT (e.g., the current 122 is determined according to $V_{BE}/(R_1+R_2)$, where the voltage $V_{BE}$ has a CTAT characteristic). Accordingly, the current 122 decreases with increasing temperature, and increases with decreasing temperature. As discussed below in connection with FIGS. 5 and 6, moreover, the compensation circuitry 150 can be used in specific implementations to facilitate compensation for any leakage current of the transistors 111 and/or 112 by sinking a second compensation current 162, having a PTAT amplitude I4, from the first feedback node 118. In addition, the $\Delta V_{GS}$ and $V_{BE}$ values are weak functions of the currents flowing through the corresponding first and second circuits 101 and 102, and accordingly current variations do not have any significant adverse impact on the bandgap voltage accuracy.

Figure 2:
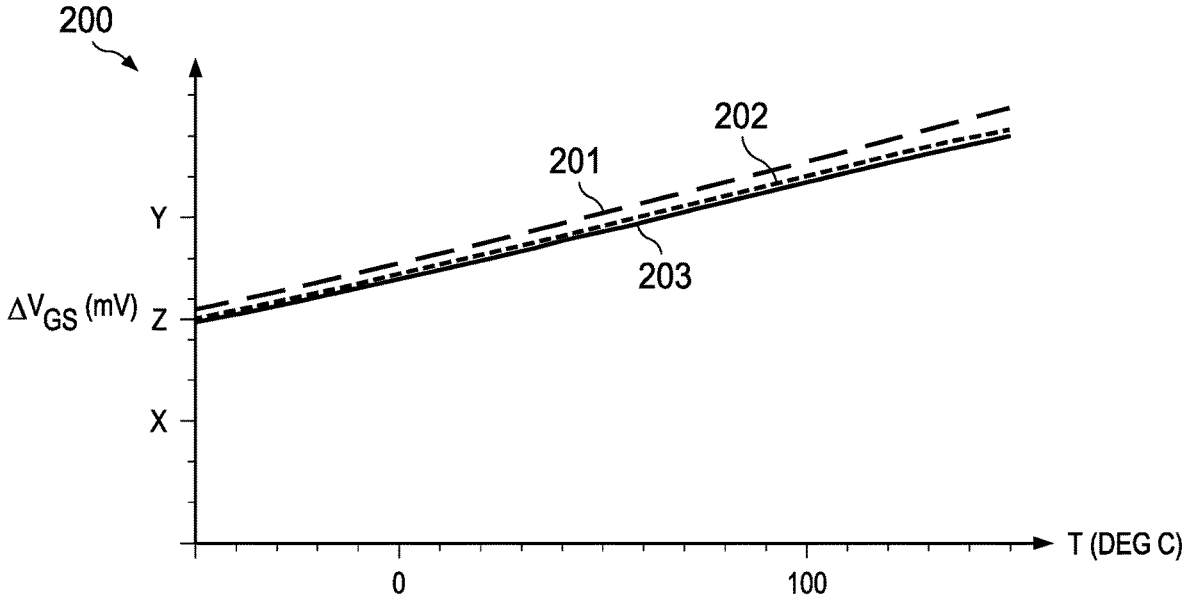
FIG. 2 is a signal diagram of signal waveforms of a self-cascoded MOSFET circuit as a function of temperature.
Figure 3:
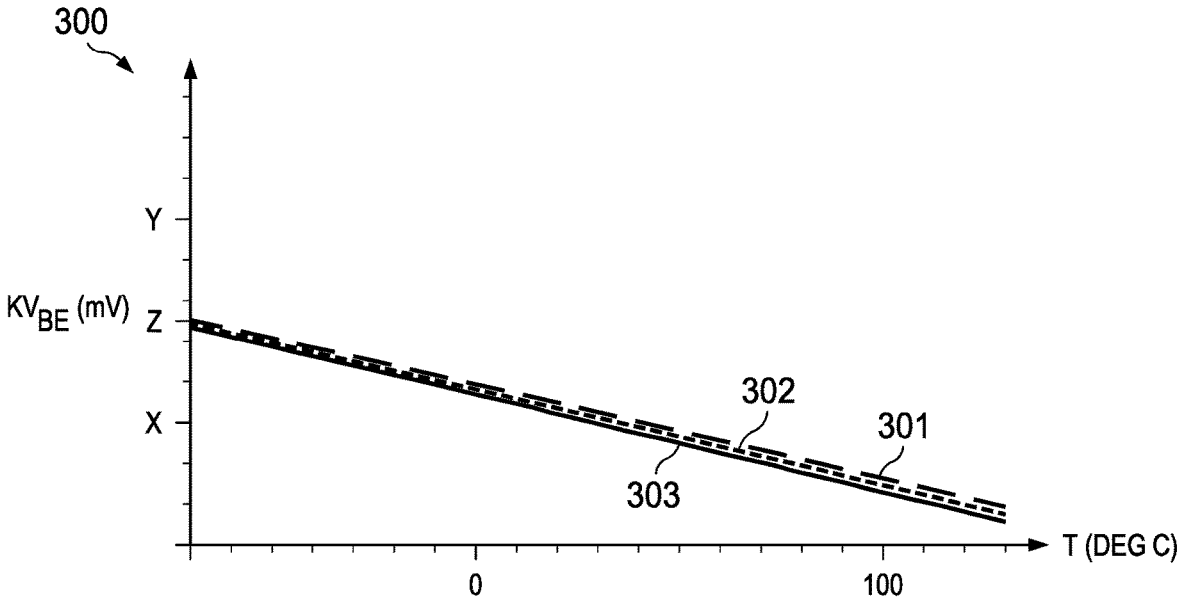
FIG. 3 is a signal diagram of signal waveforms of a diode connected bipolar transistor as a function of temperature.
Figure 4:
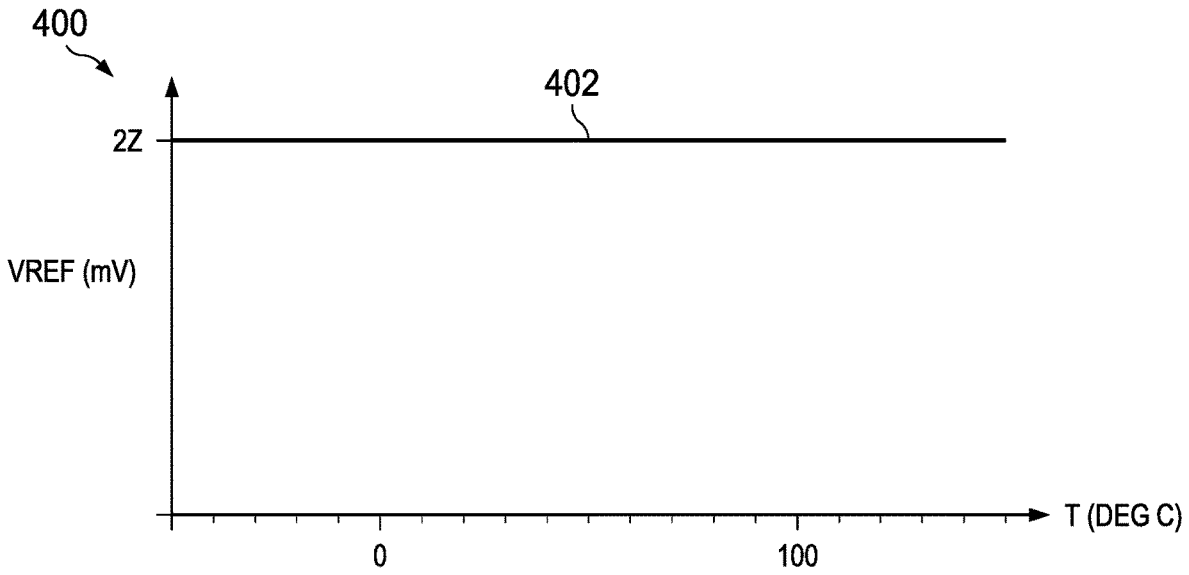
FIG. 4 is a signal diagram of an example output voltage of the bandgap voltage circuit of FIG. 1 as a function of temperature.

Referring also to FIGS. 2-4, simulation results for the example bandgap voltage circuit 100 illustrate robust accuracy across different processes. FIG. 2 shows a signal diagram with a graph 200 including curves 201, 202 and 203. The curves 201-203 illustrate PTAT temperature variance of the gate-source voltage difference between the self-cascoded circuit transistors 111 and 112 in FIG. 1 (e.g., $\Delta V_{GS}$). The curve 201 represents a circuit 100 simulated for fabrication with a first fabrication process, the curve 202 represents a circuit 100 simulated for a different second process, and the curve 203 represents a circuit 100 simulated for a different third process. The curves 201-203 have similar PTAT characteristics to one another, where each begins from or near a nominal value labeled "Z" on the vertical axis, and vary in similar proportion to one another, increasing proportionally with increasing temperature. The vertical axis in FIG. 2 includes scale markings labeled "Y" and "Z" above and below the Z value for reference. The curves 201-203 demonstrate that the self-cascoded circuit 110 in the example circuit 100 has robust PTAT performance across multiple processes.

FIG. 3 shows a signal diagram with a graph 300 that includes curves 301, 302 and 303. The curves 301-303 illustrate CTAT temperature variance of the scaled base-emitter voltage (e.g., $KV_{BE}$) of the diode-connected bipolar transistor 134 in the second circuit 102 of FIG. 1 for three processes corresponding to the curves 201-203, respectively, in FIG. 2. The CTAT curves 301-303 have similar CTAT characteristics to one another, where each curve 301-303 begins from or near a nominal value labeled "Z" on the vertical axis, and vary in similar proportion, decreasing proportionally with increasing temperature. The vertical axis scale markings labeled "Y" and "Z" in FIG. 3 represent the same scaling as used in FIG. 2. The curves 301-303 show that the example second circuit 102 in FIG. 1 has robust CTAT performance across multiple processes.

In addition FIG. 4 is a signal diagram with a graph 400 showing an output voltage curve 402 (VREF) at the output node 104 in FIG. 1. The curve 402 represents all three modeled processes corresponding to the curves in FIGS. 2 and 3, and is basically flat, showing that the overall bandgap voltage circuit 100 provides a stable temperature independent reference voltage with high accuracy over a wide temperature range as well as robustness across processes. As illustrated in FIG. 2-4, the thermally stable operation of the circuit 100 over a wide temperature range (e.g., −50° C. to +150° C.) comes from the robustness of the generated CTAT and PTAT signals in the circuit 100. In addition, the example bandgap voltage circuit 100 facilitates low-voltage, low-power operation by controlled current levels in the circuit.

The bandgap voltage circuit 100 facilitates low-voltage operation by scaling down the CTAT voltage $V_{BE}$ generated by the bipolar transistor 134, and adding the scaled CTAT voltage to the PTAT voltage $\Delta V_{GS}$ of the self-cascoded sub-threshold MOSFET transistors 111 and 112 through the closed-loop operation of the regulator circuit 120 using the scaled CTAT voltage $KV_{BE}$ as negative feedback. The example circuit 100 operates over a wide temperature range, unlike the current summing bandgap design or other low voltage CMOS reference designs, while maintaining good accuracy across multiple processes, supply voltages and temperatures (robust with respect to PVT). The disclosed examples 100 provides a bandgap design solution with robustness and accuracy, along with the ability to operate at low supply voltages, while providing circuit area economy without charge pump voltage boosting circuitry or other additional circuits.

The example circuit 100 of FIG. 1 also includes a compensation circuit 150 to provide further temperature stability. In other implementations, the compensation circuit 150 can be omitted. The example compensation circuit 150 includes an output node connected to the first feedback node 118 to offsets the I3 current 117 provided to the first circuit resistor 116 by sinking a PTAT current from the first feedback node 118. The compensation circuit 150 includes a current source 152 coupled between the supply node 106 and the reference node 108. The current source 152 has an output node that generates a first compensation current 154. The first compensation current 154 has a PTAT first amplitude, labeled IPTAT in FIG. 1, which is proportional to absolute temperature PTAT. Any suitable PTAT current source 152 can be used. The example compensation circuit 150 also includes a first current mirror transistor 156 (e.g., an NMOS) connected between the current source 152 and the reference node 108, as well as a second current mirror transistor 158 (e.g., NMOS) connected between the first feedback node 118 and the reference node 108. The output terminal of the current source 152, and the gate control terminals of the current mirror transistors 156 and 158, are connected to a control node 160. The second current mirror transistor 158 sinks a second compensation current 162 from the first feedback node 118. The second compensation current 162 has a second amplitude I4 that is proportional to the first amplitude IPTAT, and has a PTAT characteristic.

In the example of FIG. 1, the PTAT current source 152 includes an upper current mirror circuit formed by PMOS transistors 164 and 166, as well as a lower NMOS current mirror formed by the transistor 156 and a lower NMOS transistor 168. A right circuit branch or circuit leg in the current source 152 includes the series connection of the transistors 156 and 166 between the supply node 106 and the control node 160. The first feedback node 118 connects the drains of the transistors 156 and 166 to one another. A left circuit branch or leg includes the series connection of the transistors 164 and 168, as well as a resistor 170 with a resistance RS between the supply node 106 and the reference node 108. The right circuit branch conducts the PTAT output current 154 (IPTAT).

In one example, the regulator transistors 132 and 124 are sized with a ratio of 1:2 as shown in FIG. 1, and the compensation circuit 150 can be omitted. In a second example, the bandgap voltage circuit includes the compensation circuit 150, and the regulator transistors 132 and 124 are sized with a ratio of 1:1. In a third example, regulator transistors 132 and 124 are sized with a ratio of 1:1, but instead of the compensation circuit including the NMOS transistor 158 sinking a PTAT current from the current 115, the compensation circuit 150 instead includes a PMOS transistor that sources a PTAT current into the bipolar transistor 134. As shown in FIG. 1, assuming a very high impedance at the non-inverting input of the amplifier 128, the current I3 across the resistor 116 is equal to the first output current 115 (I1A) minus the compensation current 162 (I4). In operation, the compensation circuit 150 sinks the PTAT compensation current 162 from the feedback node 118. The circuit 150 facilitates conduction of additional drain current in the MOSFET transistors 111 and 112, particularly at high temperatures, to offset any effects related to increased MOSFET leakage currents or reduced Vds of transistor 111 due to reduced Vgs, at high temperatures. With a 1:1 sizing of the regulator transistors 124 and 132, the current through R1 and R2 is equal to the current 115. The current through the bipolar resistor 134 is equal to the compensation current 162. Ensuring a PTAT current through the BJT reduces the non-linear curvature error term in the CTAT VBE voltage signal.

Figure 7:
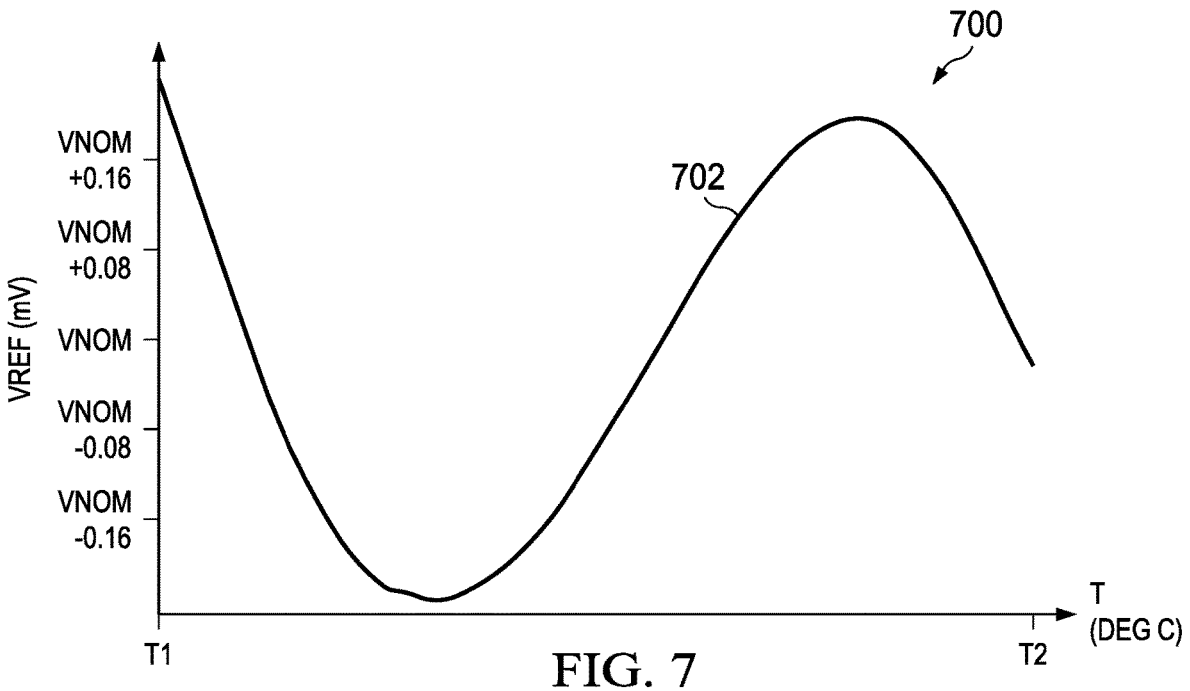
FIG. 7 is a signal diagram of an example output voltage of the bandgap voltage circuit of FIG. 1 over a first temperature range.
Figure 8:
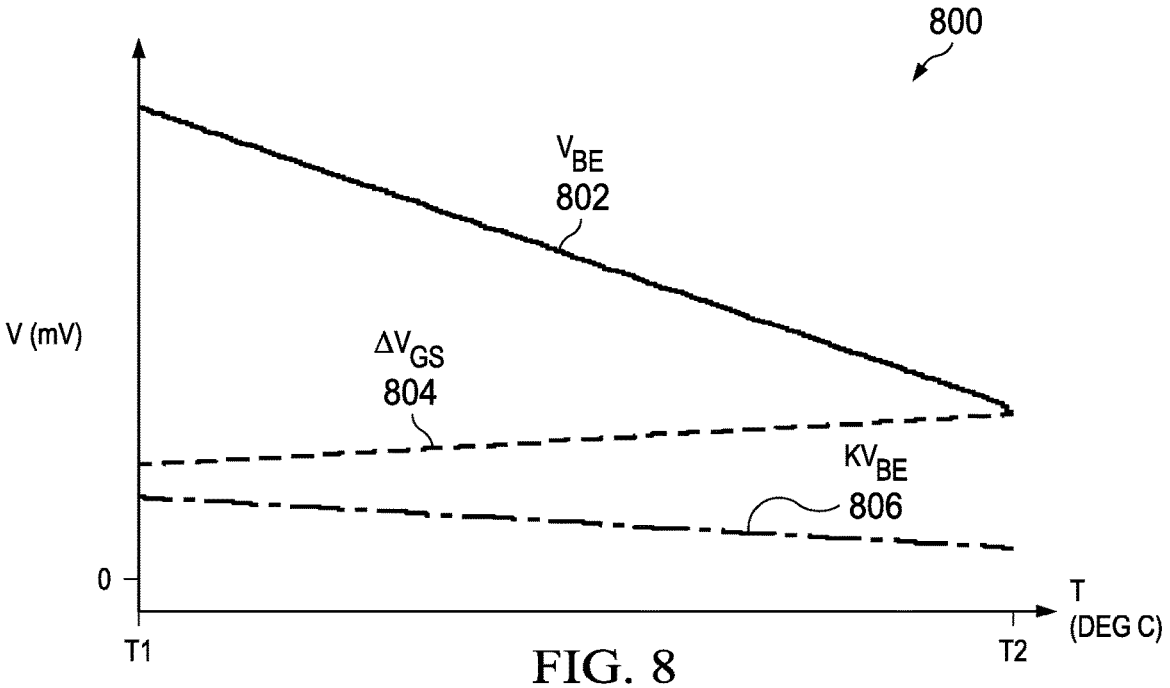
FIG. 8 is a signal diagram of example voltage waveforms of the bandgap voltage circuit of FIG. 1 over the first temperature range of FIG. 7.
Figure 9:
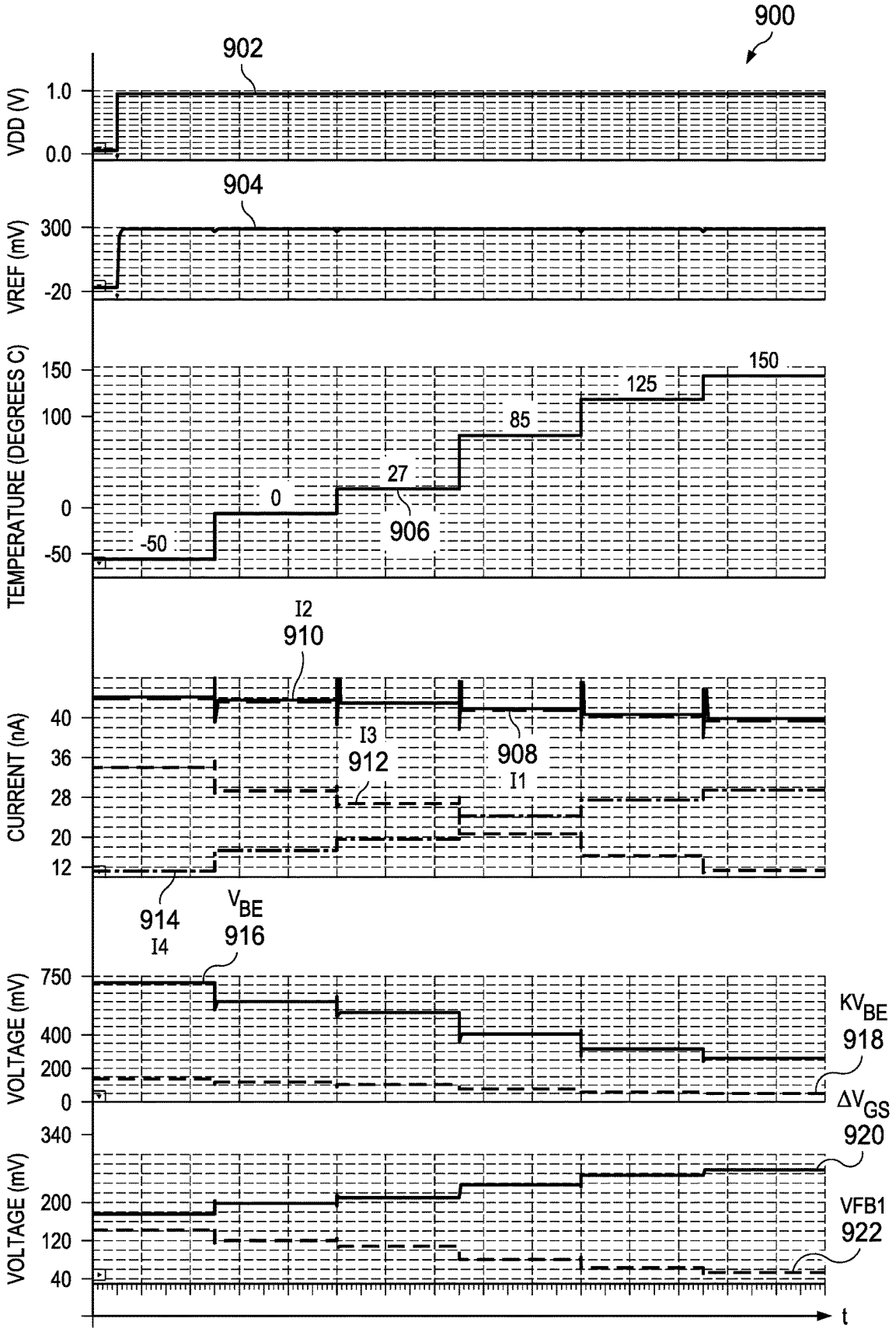
FIG. 9 is a signal diagram of example voltages and currents in the bandgap voltage circuit of FIG. 1 at different example temperatures as a function of time.

Referring now to FIGS. 5 and 7-9, FIG. 5 shows an example method 500 to generate an output voltage. FIG. 7 shows example output voltage of the bandgap voltage circuit 100 of FIG. 1 over a first temperature range, and FIG. 8 shows example voltage waveforms of the bandgap voltage circuit 100 over the first temperature range. FIG. 9 shows the response of example voltages and currents in the bandgap voltage circuit 100 to temperature changes as a function of time.

Figure 5:
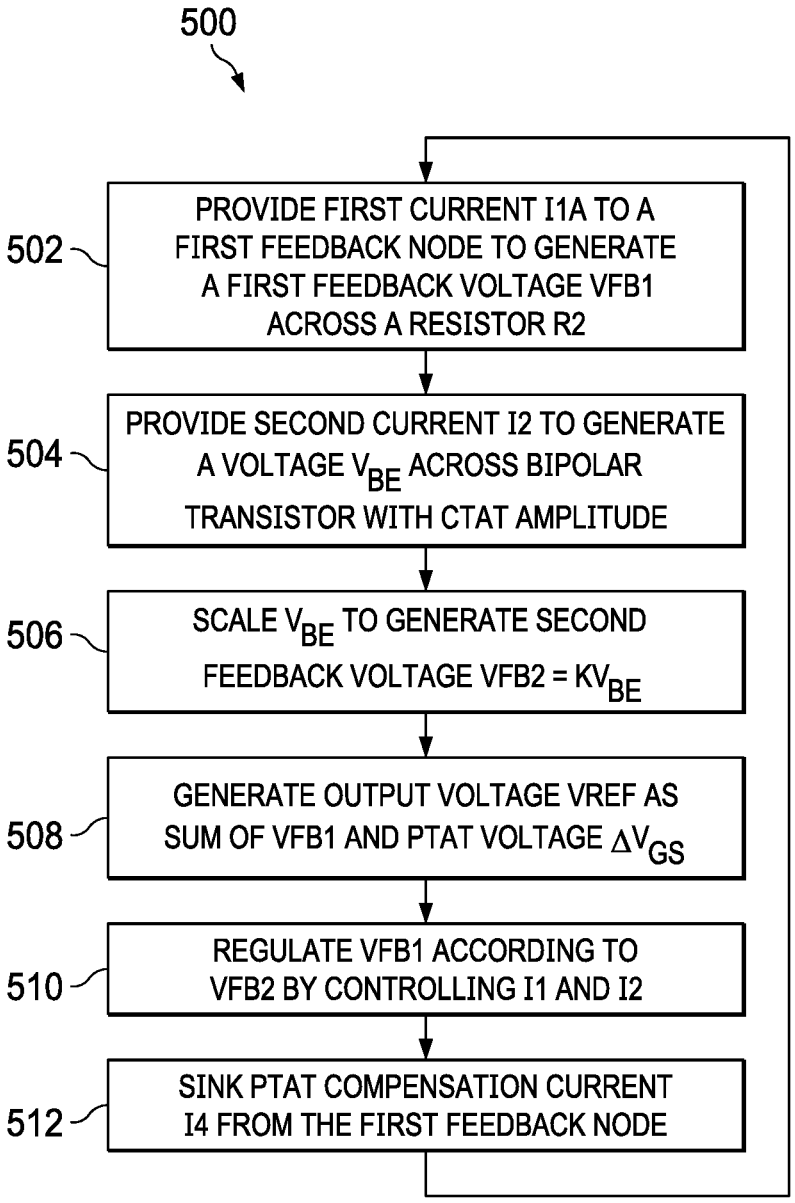
FIG. 5 is a flow diagram of a method of generating an output voltage according to another aspect of the present disclosure.

The method 500 of FIG. 5 can be implemented in a variety of bandgap circuits, such as the bandgap voltage circuit 100 of FIG. 1. The method 500 is implemented as a continuous closed loop, including providing a first current at 502 (e.g., current 121 or 115 in FIG. 1 from the first circuit 101 to the first feedback node 118) to generate a first feedback voltage across a resistor (e.g., voltage VFB1 across the resistor 116 in FIG. 1). At 504, the method 500 includes providing a second current (e.g., current 122) to generate a voltage across a diode connected bipolar transistor with an amplitude (e.g., CTAT voltage $V_{BE}$ across the transistor 134). The method 500 continues at 506 with scaling the voltage $V_{BE}$ to generate a second feedback voltage (e.g., the second feedback voltage VFB2) with an amplitude that is a fraction of the transistor voltage amplitude (e.g., $KV_{BE}$). The method 500 further includes generating an output voltage at 508 (e.g., VREF) in the first circuit 101 as a sum of the first feedback voltage and a first PTAT voltage (e.g., VFB1+VGs). At 510, the method 500 includes regulating the first feedback voltage (e.g., VFB1) according to the second feedback voltage by controlling the amplitude I1 of the first input current 121, and the amplitude I2 of a second input current 122 of the second circuit 102. In one example, the method 500 proceeds again to 502 as described above. In another example, the method 500 also includes sinking a compensation current (e.g., compensation current 162 in FIG. 1) from the first feedback node 118 at 512, where the compensation current 162 has a PTAT amplitude (e.g., I4 in FIG. 1).

Figure 6:
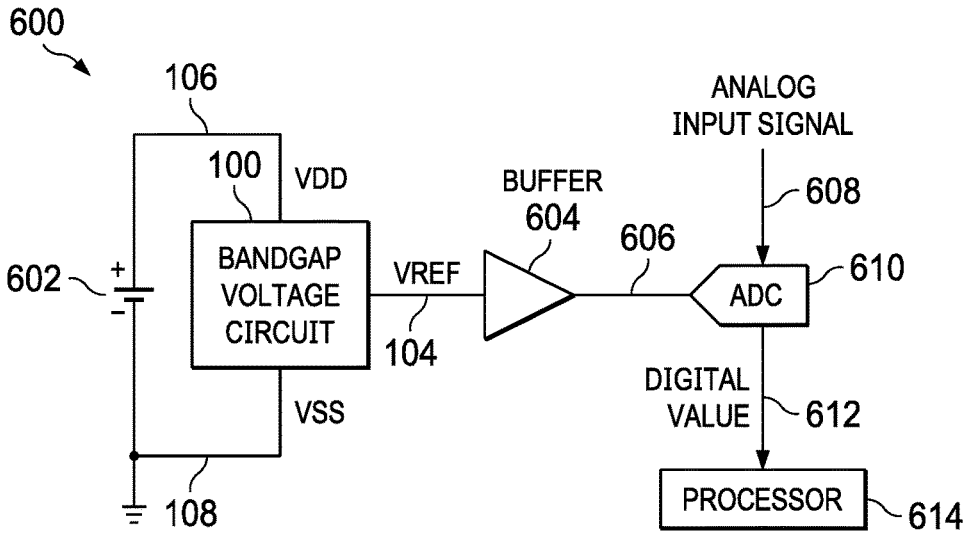
FIG. 6 is a system diagram of an example system including the bandgap voltage circuit of FIG. 1

Referring also to FIG. 6, the example circuits 100 and methods 500 can be used in a variety of different host circuits and systems to provide a stable reference voltage. FIG. 6 shows one example battery system 600 that includes a supply source 602, such as a battery, which is connected to the supply node 106. The output node 104 is connected to the input terminal of a buffer amplifier 604, and a buffer amplifier output terminal 606 is connected to an ADC 610. The ADC 610 has an analog input terminal 608 that receives an analog input signal to be converted. The ADC 610 has an output terminal or bus 612 that provides a converted digital value to a host processor 614. In other example systems, the buffer amplifier output 606 is connected to a voltage regulator, a sensor, or another host circuit component or components (not shown). The output node 104 provides the output voltage VREF as an input signal to the buffer amplifier 604. The buffer amplifier provides a stable buffered voltage signal as an input to the ADC, voltage regulator, sensor, or other host circuit component. For example, the buffered reference voltage can be used by a host ADC circuit for comparison with an input voltage signal to be converted to a digital value. In certain examples, the buffer amplifier can be omitted, and the output node 104 is connected directly to the ADC, voltage regulator, sensor, or other host circuit component to provide the output voltage VREF as an input signal thereto. The bandgap voltage circuit 100 is beneficial for low quiescent current conditions, such as in the system 600 that operates on battery or limited power.

Referring also to FIGS. 7-9, FIG. 7 shows a signal diagram 700 with an example bandgap voltage circuit output voltage signal curve 702 (e.g., VREF in FIG. 1) over a range from a first temperature T1 to a second temperature T2. FIG. 8 shows a signal diagram 800 with a curve 802 of the second input node voltage $V_{BE}$ having a CTAT characteristic from T1 to T2 (e.g., decreasing with increasing temperature). A curve 804 in FIG. 8 shows an example first voltage (e.g., $\Delta V_{GS}$) of the first circuit 101 with a PTAT characteristic (e.g., increases with increasing temperature), and a curve 806 shows the CTAT scaled voltage signal $KV_{BE}$. In the example of FIGS. 7 and 8, the variation of VREF (curve 702) from the nominal value VNOM is less than 0.2 mV over the range from T1 to T2 due to the regulation of the currents 121 and 122 according to the influence of the PTAT first voltage $\Delta V_{GS}$ on the first feedback voltage VFB1, and the CTAT influence of the bipolar transistor voltage $V_{BE}$ on the second feedback voltage VFB2.

FIG. 9 is a signal diagram of example voltages and currents in the bandgap voltage circuit 100 of FIG. 1 at different example temperatures as a function of time. A curve 902 shows the supply voltage VDD at the supply node 106 in FIG. 1 and a curve 904 shows the bandgap voltage circuit output voltage signal curve (e.g., VREF in FIG. 1). A curve 906 shows the circuit temperature, which rises in steps over time after the circuit 100 is powered on at −50 degrees C. Curve 908 show the first input current 121 (I1) provided by the first regulator transistor 124 to the self-cast coated transistor circuit 110, and curve 910 shows the second input current 122 (I2) provided by the second regulator transistor 132 to the transistor 134 of the second circuit 102. Both the currents in curves 908 and 910 are controlled by the amplifier 128 in FIG. 1 based on the difference between the voltages at the feedback nodes 118 and 138.

A curve 912 shows the current 117 (I3) through the resistor 116 of the first circuit 101, which establishes the first feedback voltage VFB1. A curve 914 shows the second compensation current 162 (I4) sinked from the first feedback node 118 by the compensation circuit 150 in the example of FIG. 1. A curve 916 in FIG. 9 shows the voltage $V_{BE}$ at the second input node 130, which is established by the second input current 122 (I2) and the operation of the bipolar transistor 134, and a curve 918 shows the scaled voltage provided as the second feedback voltage VFB2=$KV_{BE}$. Because the transistor 134 exhibits a complementary to absolute temperature (CTAT) operating characteristic, the voltages shown by the curves 916 and 918 decrease with increasing temperature. In this example, since the temperature (curve 906) increases in a stepwise fashion, the second feedback voltage curve 918 decreases in stepwise fashion.

FIG. 9 also shows a curve 920 that represents the gate-source voltage difference $\Delta V_{GS}$ of the transistors 111 and 112 of the self-cascoded transistor circuit 110. As previously discussed, this voltage difference of the circuit 110 exhibits a proportional to absolute temperature (PTAT) characteristic, and the curve 920 accordingly increases in stepwise fashion with increasing temperature. The first feedback voltage VFB1 at the first feedback node 118 is shown by curve 922 in FIG. 9, with a CTAT characteristic that decreases with increasing temperature. The cumulative effect of the CTAT characteristic of the bipolar transistor 134 in the second circuit 102, combined with the PTAT $\Delta V_{GS}$ characteristic of the self-cascoded transistor circuit 110 provides a generally stable output voltage VREF=$\Delta V_{GS}$+$KV_{BE}$ at the output node 104 that is substantially independent of the temperature of the circuit 100.

The above examples are merely illustrative of several possible embodiments of various aspects of the present disclosure, wherein equivalent alterations and/or modifications will occur to others skilled in the art upon reading and understanding this specification and the annexed drawings. Modifications are possible in the described embodiments, and other embodiments are possible, within the scope of the claims.

What is claimed is:

1. A bandgap voltage circuit, comprising:

a first circuit coupled between a supply node and a reference node, the first circuit including:

a self-cascoded transistor circuit connected between a first input node and a first feedback node, a resistor connected between the first feedback node and the reference node, and an output node connected to the self-cascoded transistor circuit;

a regulator circuit, including:

a first regulator transistor connected between the supply node and the first input node, a second regulator transistor connected between the supply node and a second input node, and an amplifier, including:

a non-inverting input terminal connected to the first feedback node, an inverting input terminal connected to a second feedback node, and an amplifier output terminal connected to control terminals of the first and second regulator transistors; and a second circuit, including:

a transistor connected between the second input node and the reference node, the transistor including a control terminal connected to the second input node, and a scaling circuit, including a first resistor connected between the second input node and the second feedback node, and a second resistor connected between the second feedback node and the reference node.

2. The bandgap voltage circuit of claim 1, wherein the resistor is configured to provide a first feedback voltage at the first feedback node with an amplitude that is controlled by a first input current;

wherein the first circuit is configured to provide an output voltage at the output node that is a sum of: a first voltage that is proportional to temperature, and the first feedback voltage;

wherein the second regulator transistor is configured to provide a second input current to the second input node according to a signal from the amplifier output terminal;

wherein the transistor of the second circuit is configured to control an amplitude of a voltage at the second input node according to the second input current, where the amplitude of the voltage at the second input node is complementary to temperature;

wherein the scaling circuit is configured to provide a second feedback voltage at the second feedback node with an amplitude that is a fraction of the voltage at the second input node; and wherein the amplifier is configured to control a first amplitude of the first input current, and a second amplitude of the second input current, according to a difference between the first and second feedback voltages.

3. The bandgap voltage circuit of claim 2, further comprising a compensation circuit, including:

a current source coupled between the supply node and the reference node, the current source including an output node configured to generate a first compensation current having a first amplitude that is proportional to temperature; and a current mirror circuit, including an input node coupled with the output node of the current source, and an output node configured to sink a second compensation current from the first feedback node, the second compensation current having a second amplitude that is proportional to the first amplitude.

4. The bandgap voltage circuit of claim 2, wherein the self-cascoded transistor circuit includes:

a first transistor, including a drain connected to the first input node, a source connected to the output node, and a gate connected to the first input node; and a second transistor, including a drain connected to the output node, a source connected to the first feedback node, and a gate connected to the first input node.

5. The bandgap voltage circuit of claim 4, further comprising a compensation circuit, including:

a current source coupled between the supply node and the reference node, the current source including an output node configured to generate a first compensation current having a first amplitude that is proportional to temperature; and a current mirror circuit, including an input node coupled with the output node of the current source, and an output node configured to sink a second compensation current from the first feedback node, the second compensation current having a second amplitude that is proportional to the first amplitude.

6. The bandgap voltage circuit of claim 1, further comprising a compensation circuit, including:

a current source coupled between the supply node and the reference node; and a current mirror circuit, including an input node coupled with the output node of the current source, and an output node coupled with the first feedback node.

7. A bandgap voltage circuit, comprising:

a first circuit, including:

a self-cascoded transistor circuit with an output node configured to generate an output voltage as a sum of: a first voltage with an amplitude that is proportional to temperature, and a first feedback voltage with an amplitude that is complementary to temperature, and a first feedback node configured to generate the first feedback voltage according to a first input current;

a second circuit, including:

a diode connected bipolar transistor with a control terminal configured to generate a voltage having an amplitude that is complementary to temperature, and a scaling circuit configured to generate the second feedback voltage with an amplitude that is a fraction of the voltage of the control terminal; and a regulator circuit configured to regulate the first feedback voltage according to the second feedback voltage by controlling the first input current of the first circuit and a second input current of the second circuit.

8. The bandgap voltage circuit of claim 7, wherein the first circuit further includes a resistor connected between the first feedback node and a reference node, the resistor configured to control the first feedback voltage according to a first output current from the self-cascoded transistor circuit.

9. The bandgap voltage circuit of claim 8, further comprising a compensation circuit, including an output node configured to sink a compensation current from the first feedback node, the compensation current having an amplitude that is proportional to temperature.

10. The bandgap voltage circuit of claim 7, wherein the regulator circuit includes:

a first regulator transistor configured to provide the first input current to the first circuit;

a second regulator transistor configured to provide the second input current to the second circuit; and an amplifier configured to control amplitudes (I1, I2) of the first and second input currents according to a difference between the first and second feedback voltages.

11. The bandgap voltage circuit of claim 7, wherein the scaling circuit includes first and second divider resistors connected in series with one another between a reference node and the control terminal of the diode connected bipolar transistor, and wherein a node that joins the first and second divider resistors is configured to generate the second feedback voltage.

12. A battery system, comprising:

a battery with an output terminal;

a bandgap voltage circuit coupled to the output terminal of the battery, the bandgap voltage circuit including:

a first circuit, including:

a self-cascoded transistor circuit with an output node configured to generate an output voltage as a sum of: a first voltage with an amplitude that is proportional to temperature, and a first feedback voltage with an amplitude that is complementary to temperature, and a first feedback node configured to generate the first feedback voltage according to a first input current, a second circuit, including:

a diode connected bipolar transistor with a control terminal configured to generate a voltage having an amplitude that is complementary to temperature, and a scaling circuit configured to generate the second feedback voltage with an amplitude that is a fraction of the voltage of the control terminal, and a regulator circuit configured to regulate the first feedback voltage according to the second feedback voltage by controlling the first input current of the first circuit and a second input current of the second circuit; and an analog to digital converter circuit, including a reference input terminal coupled with the output terminal, an analog input terminal configured to receive an analog input signal to be converted, and an output terminal or bus configured to provide a converted digital value.

13. The battery system of claim 12, further comprising a buffer amplifier with an input terminal connected to the output node of the bandgap voltage circuit, and a buffer amplifier output terminal connected the reference input terminal of the ADC.

* * * * *